US008056161B2

(12) United States Patent
Barry

(10) Patent No.: US 8,056,161 B2
(45) Date of Patent: Nov. 15, 2011

(54) SHEET SYSTEM WITH RESTRAINT

(76) Inventor: Kirsty Barry, Auckland (NZ)

( * ) Notice: Subject to any disclaimer, the term of this patent is extended or adjusted under 35 U.S.C. 154(b) by 0 days.

(21) Appl. No.: 12/596,136

(22) PCT Filed: May 5, 2008

(86) PCT No.: PCT/NZ2008/000102

§ 371 (c)(1),
(2), (4) Date: Oct. 15, 2009

(87) PCT Pub. No.: WO2008/136691

PCT Pub. Date: Nov. 13, 2008

(65) Prior Publication Data

US 2010/0050342 A1 Mar. 4, 2010

(30) Foreign Application Priority Data

May 4, 2007 (NZ) ..... 554985

(51) Int. Cl.
*A47G 9/02* (2006.01)
*A47C 16/00* (2006.01)
*A61F 5/37* (2006.01)

(52) U.S. Cl. ..... 5/494; 5/655; 5/424; 128/872; 128/869

(58) Field of Classification Search ..... 5/655, 621, 5/624, 494, 424; 128/869–875
See application file for complete search history.

(56) References Cited

U.S. PATENT DOCUMENTS

| | | | | |
|---|---|---|---|---|
| 4,858,625 | A * | 8/1989 | Cramer | 128/872 |
| 5,448,790 | A * | 9/1995 | Saro et al. | 5/657 |
| D382,642 | S * | 8/1997 | Van Gisbergen Rutherford | D24/190 |
| 5,960,493 | A * | 10/1999 | Rhey et al. | 5/424 |
| 6,161,223 | A * | 12/2000 | Andrews | 2/234 |
| D481,579 | S * | 11/2003 | Colbert et al. | D6/607 |
| 6,834,405 | B1 * | 12/2004 | Hillstead | 5/655 |
| 2003/0154549 | A1 | 8/2003 | Landry | |
| 2004/0019970 | A1 | 2/2004 | Landry | |
| 2005/0028278 | A1 * | 2/2005 | Landry | 5/494 |
| 2008/0115270 | A1 * | 5/2008 | McCarthy | 5/494 |

FOREIGN PATENT DOCUMENTS

| | | |
|---|---|---|
| AU | 199944861 B2 | 3/2000 |
| NZ | 513734 | 2/2002 |
| WO | WO9317606 A1 | 9/1993 |

* cited by examiner

*Primary Examiner* — Jonathan Liu
(74) *Attorney, Agent, or Firm* — Jeffer Mangels Butler & Mitchell LLP

(57) ABSTRACT

There is provided a sheet system for securing a child in a preferred position on a sleep surface and covering the child, the sheet system including: a base sheet; a band for securing a child in a preferred position; a first attachment means for attaching the band to the base sheet; a top sheet for covering the secured child, and a second attachment means for attaching the top sheet to the base sheet and a stabilizing means for stabilizing the base sheet on a sleep surface.

11 Claims, 11 Drawing Sheets

SHEET SYSTEM WITH RESTRAINT

STATEMENT OF CORRESPONDING APPLICATIONS

This application is based on the Provisional specification filed in relation to New Zealand Patent Application Number 554985, the entire contents of which are incorporated herein by reference.

TECHNICAL FIELD

The present invention relates to a sheet system. In particular the present invention relates to a sheet system for securing a child in a desired sleeping position on a base sheet with an attached band and covering the child with an attached top sheet.

BACKGROUND ART

There are a number of means presently used to cover a child on a sleeping surface such as standard blankets and sleep sacks which can be opened on one side to allow easy access to place a child in the sleep sack and cover at least the legs and lower abdomen of the child.

While sleep sacks keep a child warm by preventing a child's covers from being kicked off they do not prevent a child assuming a prone position which can cause potential suffocation or increase the likelihood of Sudden Infant Death Syndrome (SIDS). To address this problem sleep bands can be secured to a sleeping surface and around a child and retain it in a preferred sleeping position. Such a sleep band is disclosed in Patent No. WO9317606.

A disadvantage with such sleep bands is that the child is uncovered if not combined with some form of cover (such as a blanket) which can result in the child waking up during normal sleep time.

Pat. Nos. US20040019970 and US20030154549 describe a sleep system for a child utilizing a combined safety sheet and blanket fixed to a fitted base sheet. A disadvantage with such a system is its lack of flexibility in situations where a child must be secured in a preferred sleeping position but without the need for a top blanket or where an older child requires a top blanket but does not need to be secured.

It is an object of the present invention to address the foregoing problems or at least to provide the public with a useful choice.

Further aspects and advantages of the present invention will become apparent from the ensuing description which is given by way of example only.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art, in New Zealand or in any other country.

DISCLOSURE OF INVENTION

According to one aspect of the present invention there is provided a sheet system including:

a base sheet;
a band for securing a child in a preferred position;
a first attachment means;
a top sheet for covering the secured child, and
a second attachment means
characterised in that
the band is attached to the base sheet via the first attachment means;
the top sheet is attached to the base sheet via the second attachment means, and
the base sheet has a stabilising means for stabilising the base sheet on a sleep surface.

Preferably, the stabilising means is at least one strip extending from a border of the base sheet and at least one strip extending from an opposite border of the base sheet.

Preferably, the stabilising means is four strips, each strip extending from an opposite border of the base sheet to another said strip.

Preferably, the opposing strips are attached to one another via at least one hook and loop mating strip.

Preferably, the band may encircle the abdomen of the child and be of sufficient width to cover the chest and lower abdomen of the child.

Preferably, the first attachment means is at least one hook and loop mating strip.

Preferably, the second attachment means is at least one zip.

Preferably, the second attachment means is two zips extending substantially along two opposing edges of the top sheet.

Preferably, the top sheet covers substantially the legs and lower abdomen of the child.

Preferably, the top sheet covers the band when the sheet system is in use.

According to another aspect of the present invention there is provided a method of fitting a child to a sheet system:

said sheet system including:
a base sheet;
a band for securing a child in a preferred position;
a first attachment means;
a top sheet for covering the secured child, and
a second attachment means
characterised in that
the band is attached to the base sheet via the first attachment means;
the top sheet is attached to the base sheet via the second attachment means, and
the base sheet has a stabilising means for stabilising the base sheet on a sleep surface.
said method including the steps:
fitting the base sheet to a sleeping surface;
stabilising the base sheet by securing the stabilising means under the sleeping surface;
opening the sides of the attached top sheet;
opening the band attached to the top sheet;
placing a child substantially over the opened band in a preferred position;
securing the band around the abdomen of the child in a preferred position, and
fastening the top sheet attached to the base sheet over the child.

Thus, preferred embodiments of the present invention may have a number of advantages over the prior art which can include:

permanent coverage to the child by avoiding the child wrapping its covers around itself and kicking its covers off;

retaining the child in a preferred sleeping position;

providing convenience of use over a separate sleep sack, safety band and/or fitted base sheet, and adjustability to accommodate children of different sizes.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

The invention is now described in relation to one preferred embodiment of the present invention as shown in FIGS. 1 to 11. It should be appreciated that the invention may be varied from the Figures without departing from the scope of the invention.

Figure 1:
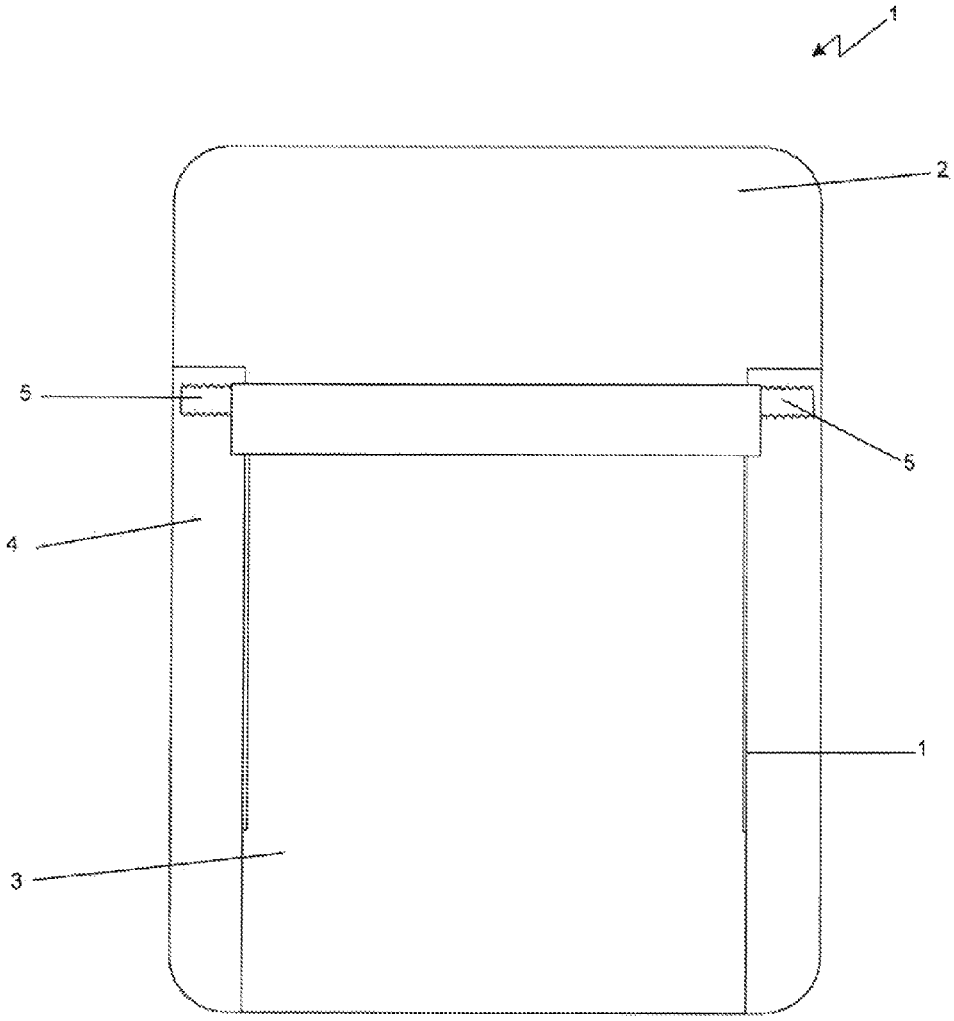
FIG. 1 shows a plan view of a preferred embodiment of the sheet system of the present invention.
Figure 2:
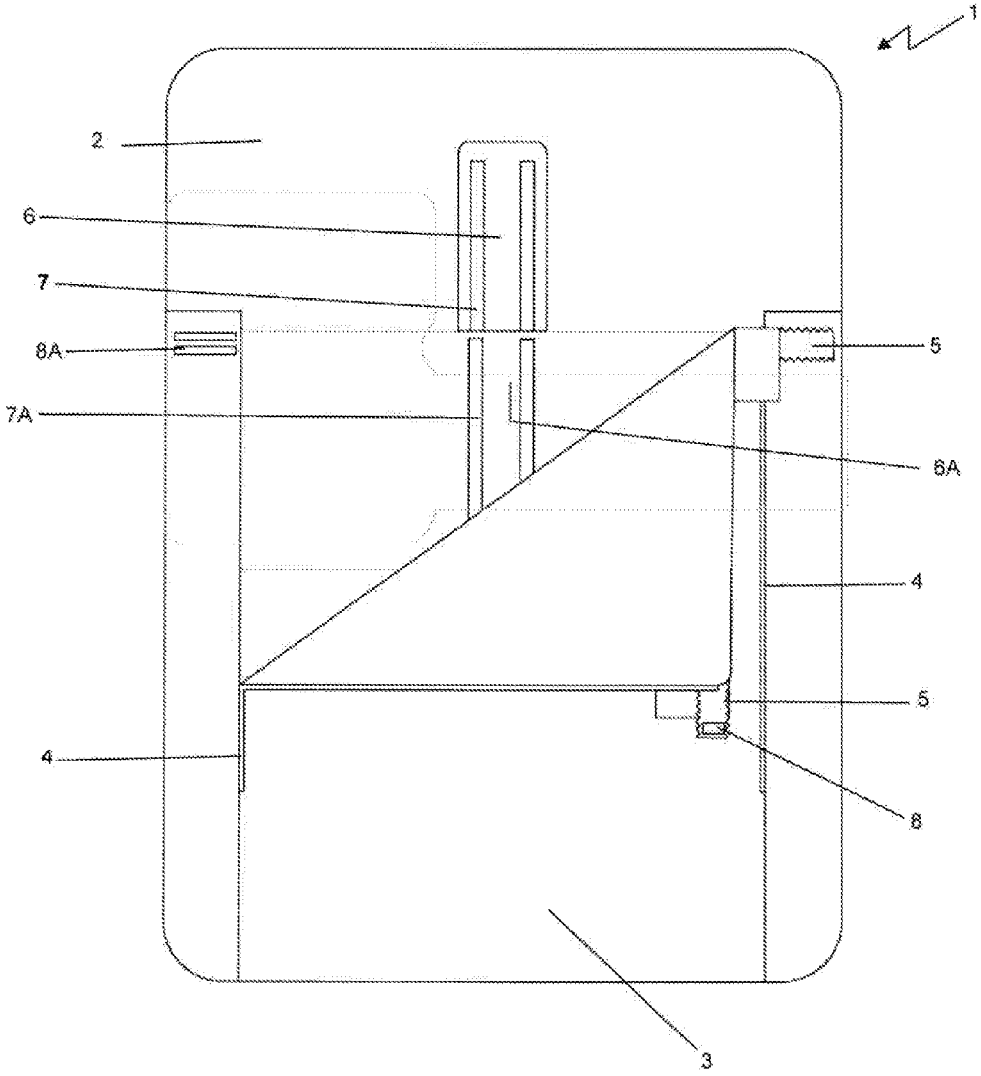
FIG. 2 shows a plan view of the preferred embodiment shown in FIG. 1 with the top sheet open at one side and the band removed.
Figure 3:
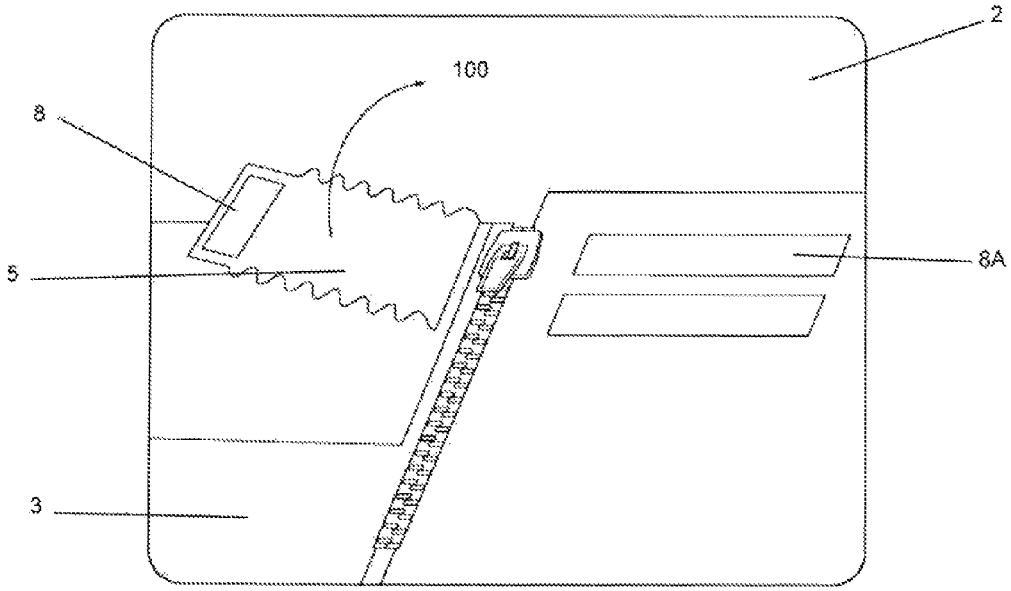
FIG. 3 shows a schematic view of a close up of the fastening arrangement at the top right corner of the top sheet of the preferred embodiment shown in FIG. 1.

FIGS. 1 to 3 show a sheet system generally indicated by arrow 1. A base sheet 2 has a top sheet 3 attached via two zips 4 running substantially the length of two sides of the top sheet 3. In this way the top sheet 3 may be opened or closed to allow access to place or retrieve a child respectively from either side of the sleeping surface.

Two tabs 5 are attached to the upper two corners of the top sheet 3 and may be folded (in the direction of arrow 100 shown in FIG. 3) to secure over the top of the closed zips 4 to prevent them from being undone by a child (not shown). A loop for a band 6 is permanently attached by stitching to the base sheet at one edge 6A and attached to the base sheet via hook 7 and loop 7A mating strips. The tabs 5 are attached to the base sheet via hook 8 and loop 8A mating strips.

Figure 4:
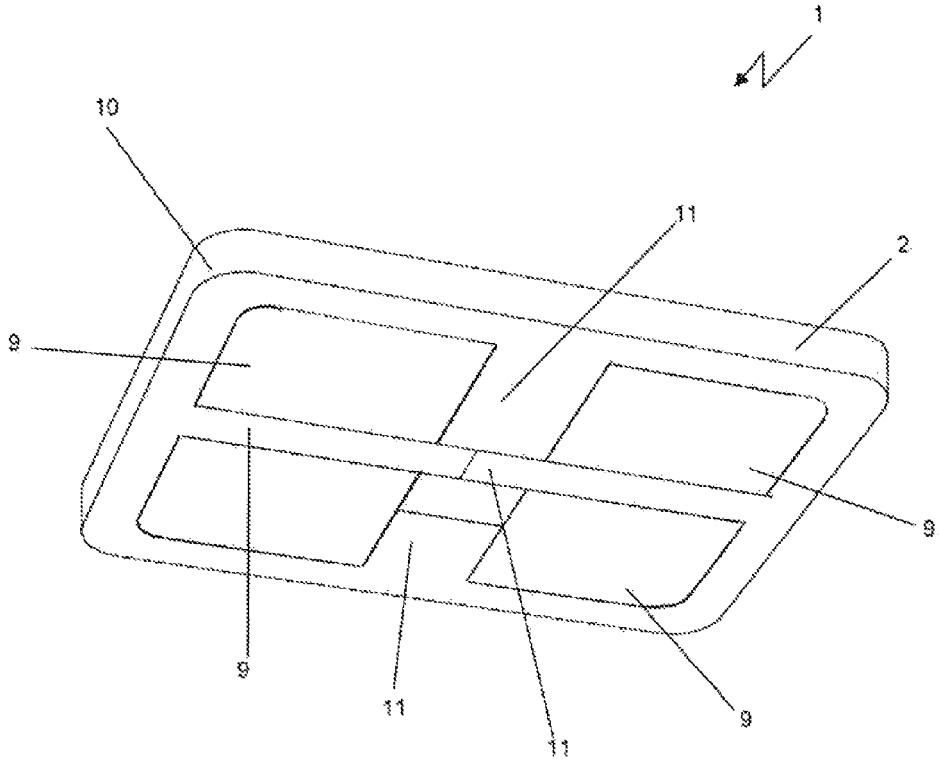
FIG. 4 shows a bottom side elevation view of the preferred embodiment shown in FIG. 1 attached to a sleeping surface.
Figure 5:
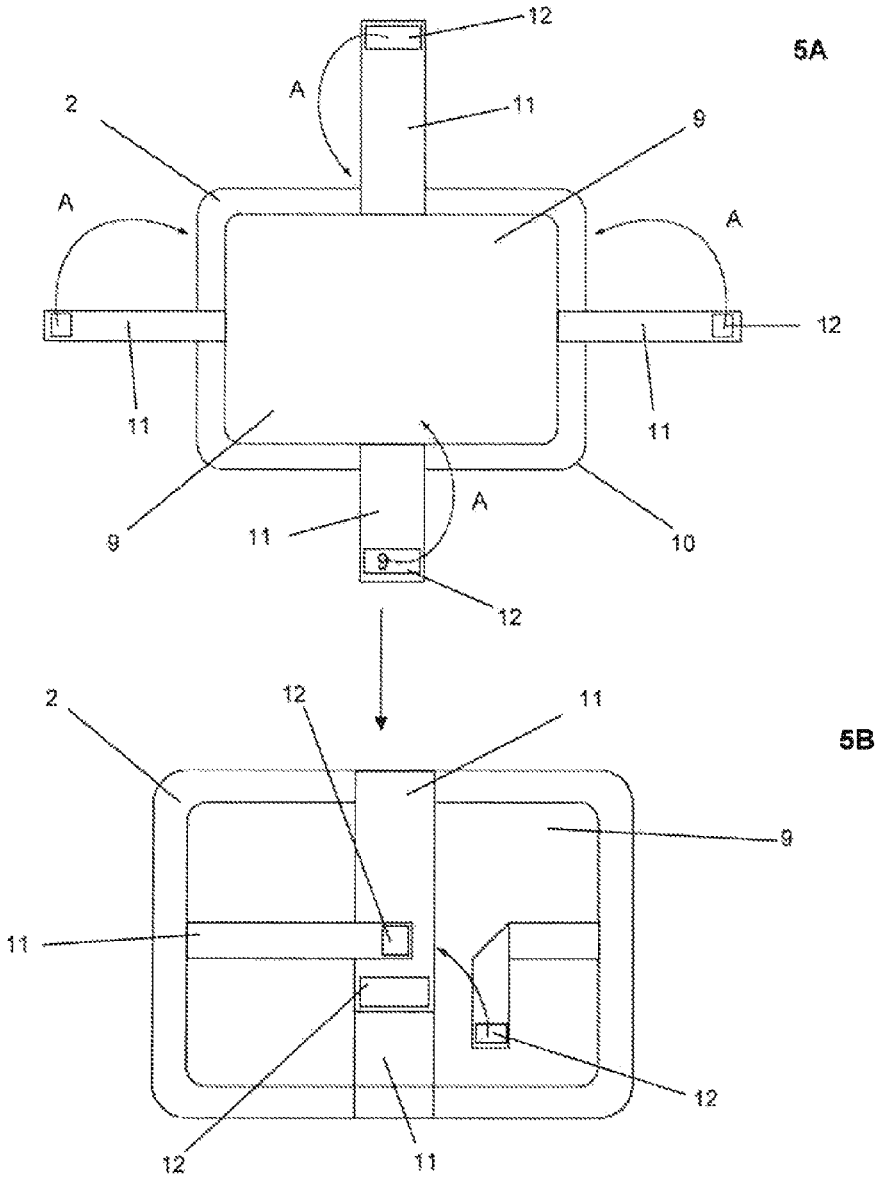
FIG. 5 shows two bottom schematic views A and B illustrating the preferred method of fastening the sheet system of the preferred embodiment shown in FIG. 1 to a sleeping surface.
Figure 6:
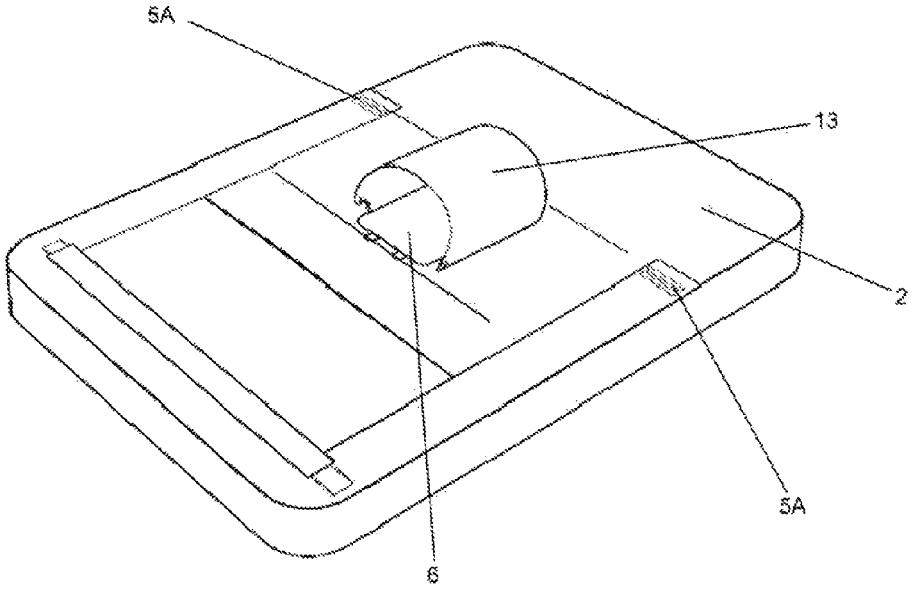
FIG. 6 shows a side elevation view of the preferred embodiment shown in FIG. 1 with the top sheet removed.
Figure 7:
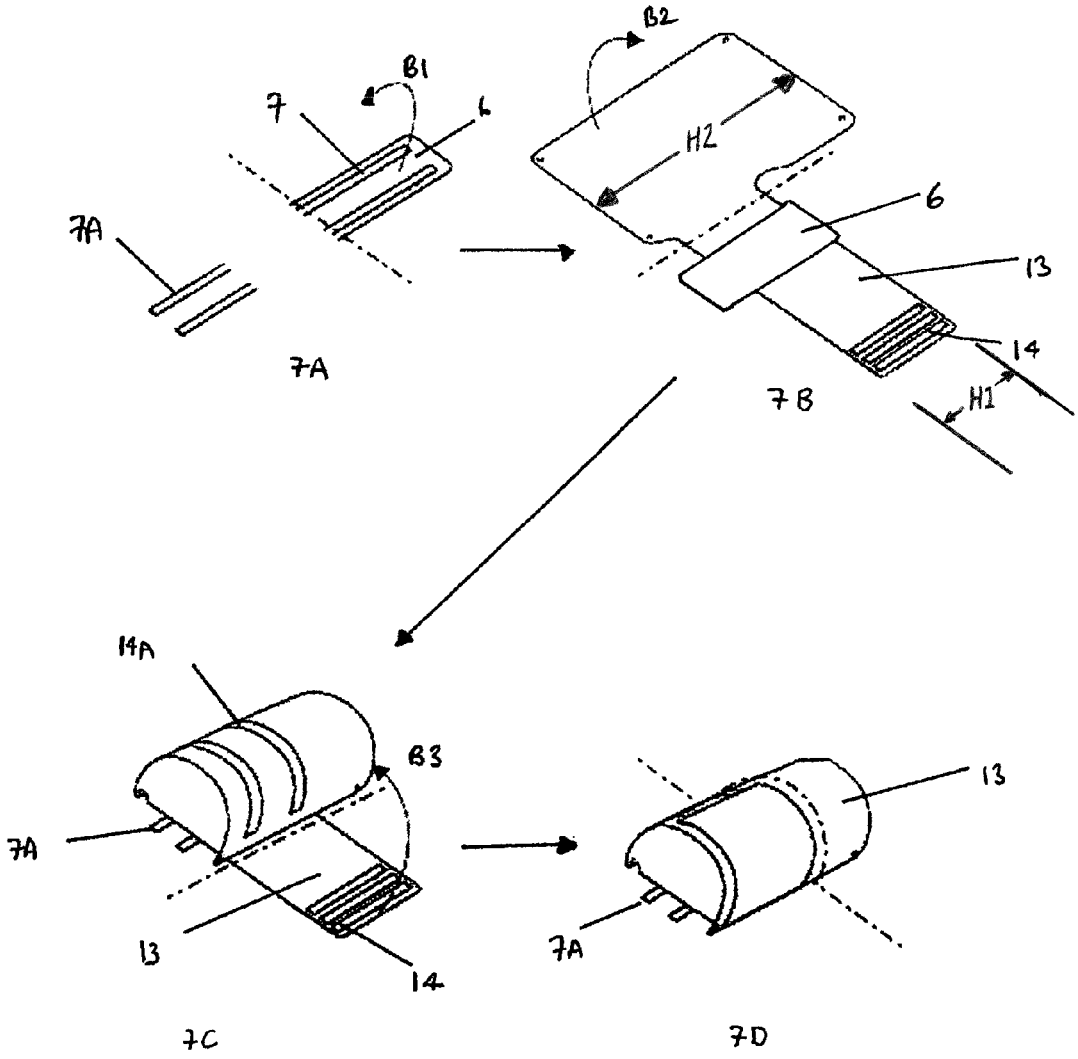
FIG. 7 shows four schematic views A to D of the preferred embodiment shown in FIG. 1 illustrating the preferred method of fastening the band to the base sheet.

FIGS. 4 and 5A and 5B show the base sheet 2 of the sheet system 1 fitted to a sleeping surface 9 by a second attachment means in the form of an elasticated border 10 and a stabilising means in the form of four stabilizing strips 11 which fit under the sleeping surface 9 and attach to each opposite number via hook mating strips 12 folded in the direction of arrows A. In this way movement of a child secured in the band 6 and top sheet 3 of the sheet system 1 will be stabilized and prevent the base sheet 2 from becoming detached from the sleeping surface 9.

The first and second attachment means may be any reversible attachment means such as hook and loop mating strips; tie; adhesive tape; zips, or other reversible attachment means known in the art. The stabilization means may be any means of stabilising the base sheet 2 on a sleeping surface, such as ties, loops, buckles and straps, and should not be seen to limit the scope of the present invention.

FIGS. 6 and 7A to 7D shows a band 13 attached to the base sheet 2 by a first attachment means in the form of a loop for a band 6 which folds over the L-shaped band 13 in the direction of arrow B1 (FIG. 7A). The band 13 is folded over the closed loop 6 in the direction B2 (FIG. 7B) and attached to itself with hook 14 and loop 14A mating strips in the direction of arrow B3 (FIG. 7C) to form a closed band (FIG. 7D). L-shaped band 13 includes a first portion and second portion. As shown in FIGS. 7A-D, the second portion has a height dimension that is greater than the height dimension of the first portion.

Figure 8:
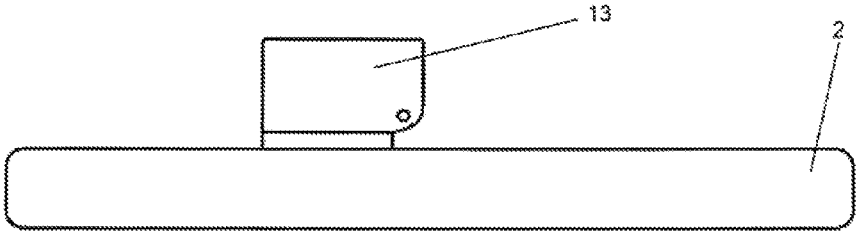
FIG. 8 shows a side view of the preferred embodiment shown in FIG. 1 attached to a sleeping surface with the top sheet removed.
Figure 9:
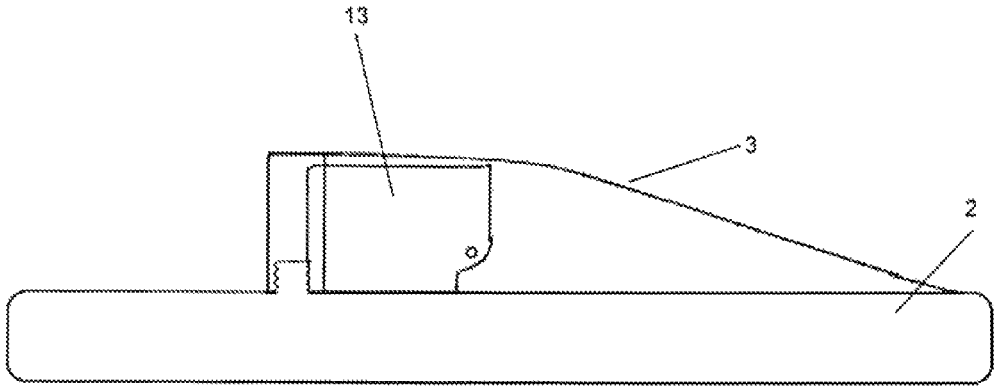
FIG. 9 shows a side view of the preferred embodiment shown in FIG. 1 attached to a sleeping surface.

FIGS. 8 and 9 show side views of the band 13 attached to a base sheet 2 without the top sheet 3 (FIG. 8) and with the top sheet 3 (FIG. 9) covering the band 13.

Figure 10:
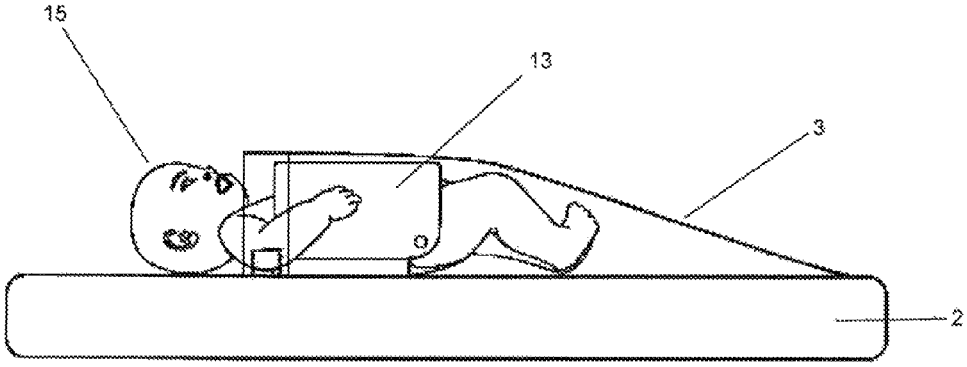
FIG. 10 shows a side view of the preferred embodiment shown in FIG. 1 attached to a sleeping surface and with a child positioned in the system.

FIG. 10 shows a child 15 secured in a preferred position by the band 13 and kept warm by the top sheet 3 which is attached over the child 15 and band 13.

Figure 11:
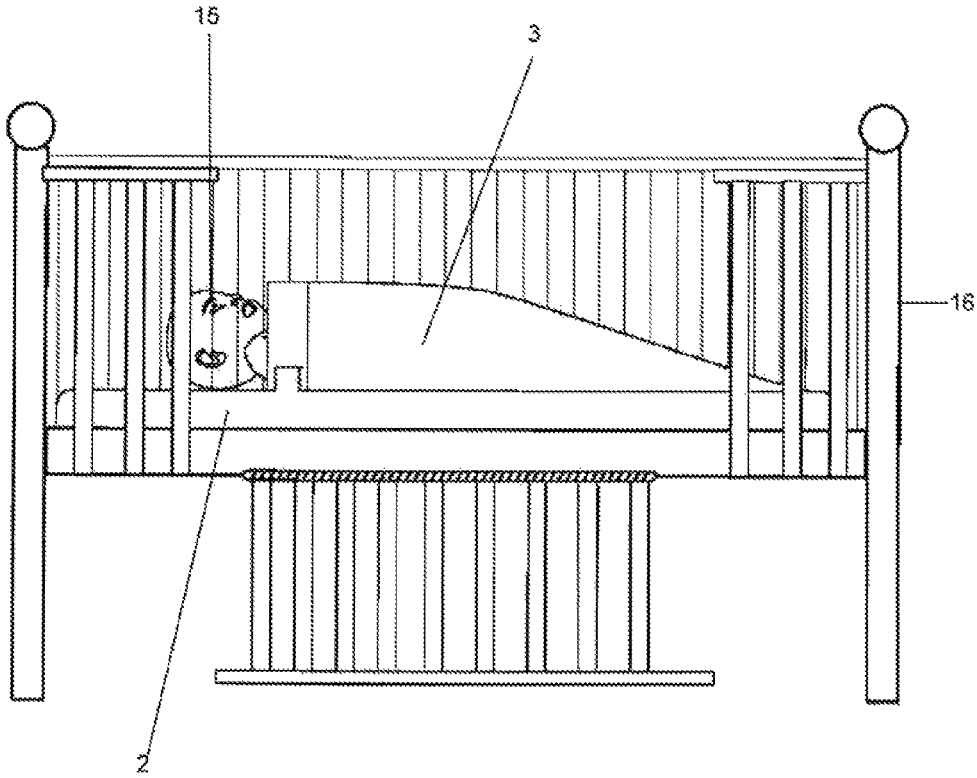
FIG. 11 shows a side view of the preferred embodiment shown in FIG. 1 attached to a sleeping surface in a cot and with a child positioned in the system.

FIG. 11 shows a child 15 secured in a preferred position in a cot 16 on the base sheet 2 and covered by the top sheet 3.

The band may encircle the abdomen of the child and be of sufficient width and length to cover the chest and lower abdomen of the child. In this way the band is not unduly narrow to cause injury to the child if the band is adjusted too tight.

The preferred sleeping position for the child 15 may be substantially on its side or back but not in a prone position with its face substantially covered by the sleeping surface.

The top sheet may cover substantially the legs and lower abdomen of a child 15 in a preferred position on a sleeping surface. The top sheet covers the band when the sheet system is in use.

The sheet system may be made from a material that will provide comfort and warmth to a child but be of sufficient strength to provide security when a child is placed in the sheet system such as cotton; polyester; nylon; wool; or a mixture of the foregoing.

In use the sheet system 1 is:

fitted to a sleeping surface 9 and stabilized by securing the stabilising strips 11 under the sleeping surface 9;

the sides of the attached top sheet 3 are opened;

the band 13 secured to the base sheet 2 with a first attachment means in the form of a loop for a band 6 is opened;

a child 15 is placed substantially over the opened band 13;

the band 13 is secured around the abdomen of the child 15 in a preferred sleeping position;

the top sheet 3 is secured over the child 15 by closing of the second attachment means in the form of zips 4, and the top of the closed zips 4 are secured by folding over tabs 5.

It is an object of the present invention to provide a fully integrated sleep sheet system for a child including a separate sleeping band and top sheet attached to a base sheet for a sleeping surface to secure a child in a preferred sleep position and cover the child in such a way as to prevent a child from wrapping unattached sheets and blankets around their legs and in turn kicking the cover off.

Aspects of the present invention have been described by way of example only and it should be appreciated that modifications and additions may be made thereto without departing from the scope thereof as defined in the appended claims.

The claims defining the invention are:

1. A sheet system including:

a base sheet;

a band for securing a child in a preferred position;

a first attachment;

a top sheet for covering the secured child, and a second attachment characterised in that the band is attached to the base sheet via the first attachment, wherein the band is generally L-shaped such that it includes a first portion and a second portion, wherein the second portion has a height dimension that is greater than the height dimension of the first portion, wherein the first attachment comprises a strap having first and second opposite ends that are each secured to the base sheet and a middle portion that overlies and secures the first portion of the band, wherein the first end of the strap is permanently attached to the base sheet and the second end of the strap is releasably secured to the base sheet, whereby the second end of the strap can be unsecured from the base sheet so that the band can be removed from the base sheet;

the top sheet is attached to the base sheet via the second attachment;

the base sheet has a stabilising means for stabilising the base sheet on a sleep surface; and wherein, in use, the band encircles the abdomen of the child and is of sufficient width to cover the chest and lower abdomen of the child.

2. A sheet system as claimed in claim 1 wherein the stabilising means comprises first and second strips each having a first end attached to a border of the base sheet and a second end, wherein the first and second strips extend from opposing borders of the base sheet, wherein the second end of the first strip is releasably attached to the second end of the second strip.

3. A sheet system as claimed in claim 2 wherein the stabilising means further comprises third and fourth strips having a first end attached to a border of the base sheet and a second end, wherein the third and fourth strips extend from opposing borders of the base sheet, wherein the second end of the third strip is releasably attached to the second end of the fourth strip, and wherein the third and fourth strips at least partially overlap the first and second strips.

4. A sheet system as claimed in claim 3 wherein the second ends of the opposing strips are attached to one another via at least one hook and loop mating strip.

5. A sheet system as claimed in claim 1 wherein the second end of the strap is releasably secured to the base sheet by at least one hook and loop mating strip.

6. A sheet system as claimed in claim 1 wherein the second attachment comprises at least one zip.

7. A sheet system as claimed in claim 6 wherein the second attachment comprises first and second zips extending substantially along two opposing edges of the top sheet.

8. A sheet system as claimed in claim 7 wherein the top sheet includes first and second tabs extending outwardly therefrom, wherein the first and second tabs are releasably secured to the base sheet and over the first and second zips, respectively to prevent the first and second zips from being unzipped.

9. A sheet system as claimed in claim 1 wherein the top sheet covers substantially the legs and lower abdomen of the child.

10. A sheet system as claimed in claim 1 wherein the top sheet covers the band when the sheet system is in use.

11. A method of fitting a child to a sheet system: said sheet system including:

a base sheet;

a band for securing a child in a preferred position;

a first attachment;

a top sheet for covering the secured child; and a second attachment; characterized in that the band is attached to the base sheet via the first attachment, wherein the band is generally L-shaped such that it includes a first portion and a second portion, wherein the second portion has a height dimension that is greater than the height dimension of the first portion, wherein the first attachment comprises a strap having a first end attached to the base sheet and a second end that is loose;

the top sheet is attached to the base sheet via the second attachment; and the base sheet has a stabilising means for stabilising the base sheet on a sleep surface; said method including the steps:

fitting the base sheet to a sleeping surface;

stabilizing the base sheet by securing the stabilizing means under the sleeping surface;

opening the sides of the attached top sheet;

securing the band to the bottom sheet by laying the band on the bottom sheet, laying the strap over the first portion of the band and securing the second end of the strap to the bottom sheet;

placing a child substantially over the strap and the opened band in a preferred position;

encircling and securing the band around the chest and lower abdomen of the child in a preferred position; and fastening the top sheet attached to the base sheet over the child.

* * * * *